United States Patent [19]

Crow

[11] Patent Number: 4,880,184

[45] Date of Patent: Nov. 14, 1989

[54] YARN PACKAGE SUPPORT FOR CREEL

[76] Inventor: Mitchell A. Crow, 2279 Kerr Rd., NW., Dalston, Ga. 30720

[21] Appl. No.: 246,401

[22] Filed: Sep. 19, 1988

[51] Int. Cl.[4] ..... B65H 49/04

[52] U.S. Cl. ..... 242/130; 242/131; 242/139; 242/141

[58] Field of Search ..... 242/130, 130.1, 131, 242/131.1, 129.5, 129.7, 129.71, 134, 139, 141

[56] References Cited

U.S. PATENT DOCUMENTS

| | | | |
|---|---|---|---|
| 1,712,059 | 5/1929 | Trevett | 242/131 |
| 2,349,639 | 5/1944 | Theiler | 242/131.1 |
| 2,437,471 | 3/1948 | Moore | 242/131.1 |
| 3,150,845 | 9/1964 | Pool | 242/131 |
| 4,023,747 | 5/1977 | Champagne | 242/130 |
| 4,760,977 | 8/1988 | Wright, Jr. et al. | 242/130 |

*Primary Examiner*—Stanley N. Gilreath
*Attorney, Agent, or Firm*—James B. Middleton

[57] ABSTRACT

A pivotal yarn package holder allows convenience in replacing a yarn package on a creel or the like, and locks into place for use. The support can be adjusted so that the strand of yarn is precisely aimed at the eyelet, and the yarn package will always return to the preset position. A post is mounted from the creel frame, and a latch block is fixed to the post by a set screw. A support block carrying the yarn package is juxtaposed on the latch block, and a latch is easily operable to latch the support block to the latch block. A cone holder has the spring wires below the rigid stud so the stud carries the weight of the yarn to prevent sagging of the yarn package.

11 Claims, 2 Drawing Sheets

YARN PACKAGE SUPPORT FOR CREEL

INFORMATION DISCLOSURE STATEMENT

A creel for supporting a plurality of packages of yarn is well known in the art, and many variations have been devised. It has also been recognized in the past that yarn packages are easier to exchange if the support for the yarn package is pivotal to allow easier access to the support. One form of such pivotal support is shown in the U.S. Pat. No. 3,150,845, and another is shown in U.S. Pat. No. 4,023,747. In both these prior art arrangements, the yarn package is held in its intended position by gravity. Both devices are arranged such that the yarn package is pivotal from a use position to a replacement position, and the yarn package can be quickly returned to its use position and held in the use position by gravity. Adjustments of the use position require manipulation of the attachment to the creel frame so that misalignment is likely, and many readjustments may be necessary.

With the present high-speed processing of yarns, and especially processing such as the air entangling of yarns, it is important to have the yarn packages precisely aligned with the eyelet or other guide means. As a result, there is an exceptionally great need to be able to align the yarn package support means with the first guide means of the creel, and such alignment should be ultimately made by relatively unskilled labor. Once the yarn package has been properly set, the yarn package needs to be easily replaceable, and the new yarn package should return to its preset position without the danger of bouncing or being inadvertently displaced from its intended position.

SUMMARY OF THE INVENTION

This invention relates generally to creels for yarns or the like, and is more particularly concerned with a selectively pivotal yarn package support means for a creel.

The present invention provides a package support means including a cone holder for receiving the yarn package, the cone holder being selectively rotatable about a generally fixed axis. A latch means selectively locks the cone holder to the latch block, the latch block being selectively rotatable about said axis. A post extends along said axis and is carried by an arm extending from the creel frame. The cone holder is carried by a support block which is preferably provided with bearing means for providing easy rotation of the cone holder to and from the use position and reloading position.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
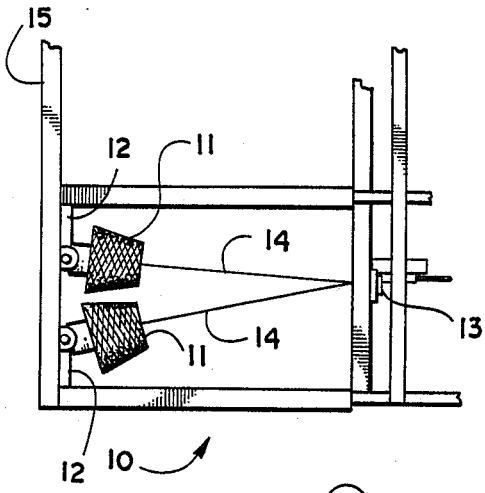
FIG. 1 is a top plan view of a portion of a creel having the yarn package support means of the present invention mounted thereon.

Referring now more particularly to the drawings, and to those embodiments of the invention here presented by way of illustration, FIG. 1 shows a creel generally designated at 10, the creel including yarn packages 11 carried by support means generally designated at 12. The yarns 14 from the yarn packages 11 extend across the creel 10 to an eyelet 13 or other guide means, and several of the yarns 14 are typically gathered together and directed to a yarn processing means which is not here illustrated. Those skilled in the art will understand that the creel normally includes a lost-end detector, tensioning means and the like. Such apparatus is well known in the art, and forms no part of the present invention.

FIG. 1 shows only one section of the creel 10, and it will be understood that package support means 12 will be distributed throughout the height of the creel 10, and will be distributed along the width of the creel 10, towards the top of the page as illustrated in FIG. 1. The number of the yarn packages 11 makes it very difficult to remove an empty cone and replace the cone with a full yarn package. As a result, it is highly desirable to be able to pivot the yarn package 11 to the rear 15 of the creel 10. With the empty cone protruding through the creel, a new package 11 can be placed on the cone support, and the new yarn package can be returned to the position as illustrated in FIG. 1.

Figure 2:
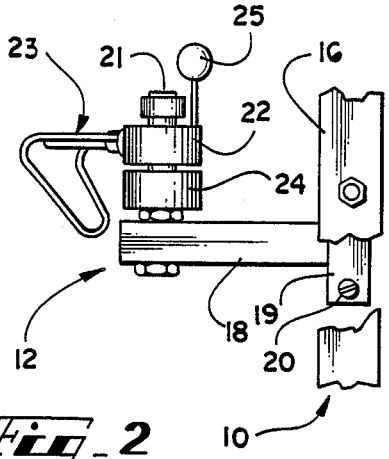
FIG. 2 is a fragmentary rear elevational view showing one of the yarn holding means of the present invention and its connection to the creel frame.

Looking at FIG. 2 of the drawings, a portion of the vertical frame member 16 of the creel 10 is illustrated, and it will be seen that a mounting arm 18 is fixed to the member 16 by means of a flange 19 and a pair of screws 20. The arm 18 is therefore rigidly fixed to the vertical member 16 and carries the pivotal yarn package support generally designated at 12.

The support 12 includes a post 21 carrying a support block 22 having a cone holder 23 extending therefrom. Below the support block 22 is a latch block 24, the support block 22 being selectively rotatable with respect to the latch block 24. Rotation of the support block is allowed by release of the latch through the latch handle 25.

Figure 3:
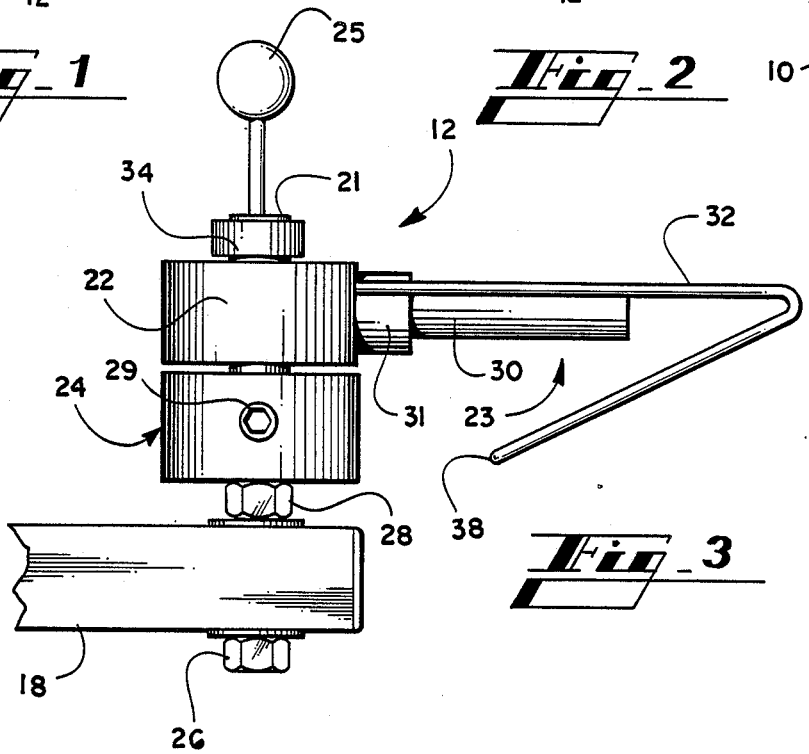
FIG. 3 is an enlarged side elevational view of the yarn package support means shown in FIG. 2.
Figure 4:
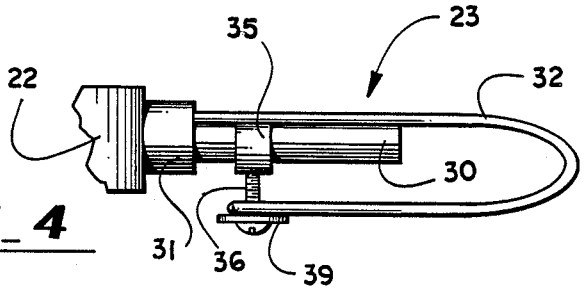
FIG. 4 is a fragmentary side elevational view showing a modification of the cone holder illustrated in FIG. 3.

Attention is next directed to FIG. 3 of the drawings which shows the cone holder 23 in side elevation and which shows the support means 12 large enough for a better understanding of the construction. In FIG. 3 it will be noted that the post 21 extends downwardly through the arm 18, and is held by a pair of nuts 26 and 28 on each side of the arm 18. Above the nut 28, the latch block 24 is received over the post 21, the latch block 24 being selectively held in position by means of a set screw 29. The support block 22 is above the latch block 24, and the support block 22 has the cone holder 23 extending therefrom. The cone holder 23 includes a stud 30 extending from the support block 22, the stud 30 carrying a bracket 31 which receives the wire cone engaging means 32. It is well known to those skilled in the art that a resilient wire such as the wire 32 is utilized on cone supports, the wire 32 being spring urged outwardly to engage the cone with sufficient force to prevent inadvertent removal thereof.

Above the support block 22 there is a stop collar 34 to hold the support block 22 in place. It will therefore be seen that the latch can be manipulated by means of the latch handle 25, and the support block 22 can rotate freely with respect to the latch block 24 as will be discussed hereinafter, the latch mechanism latches in only one rotational position of the support block 22 with respect to the latch block 24; therefore, a single position can be set for the support block 22, and that single position can be repeated as often as desired. Since the position of the support block 22 is relative to the position of the latch block 24, it will also be understood that the set screw 29 can be loosened, and the position of the latch block 24 varied with respect to the arm 18 to vary the ultimate position of the support block 22.

There are times that the wire 32 provides more force than is desired in its engagement with a cone. Using the cone holder 23 of the present invention, it will be noted that a collar 35 can be received around the stud 30, the collar 35 having a screw 36 extending therefrom. The screw 36 can therefore pass through the return bend 38 of the wire 32, with a washer 39 if required, and the end of the wire 32 will be held up to reduce the force exerted against a cone.

Figure 5:
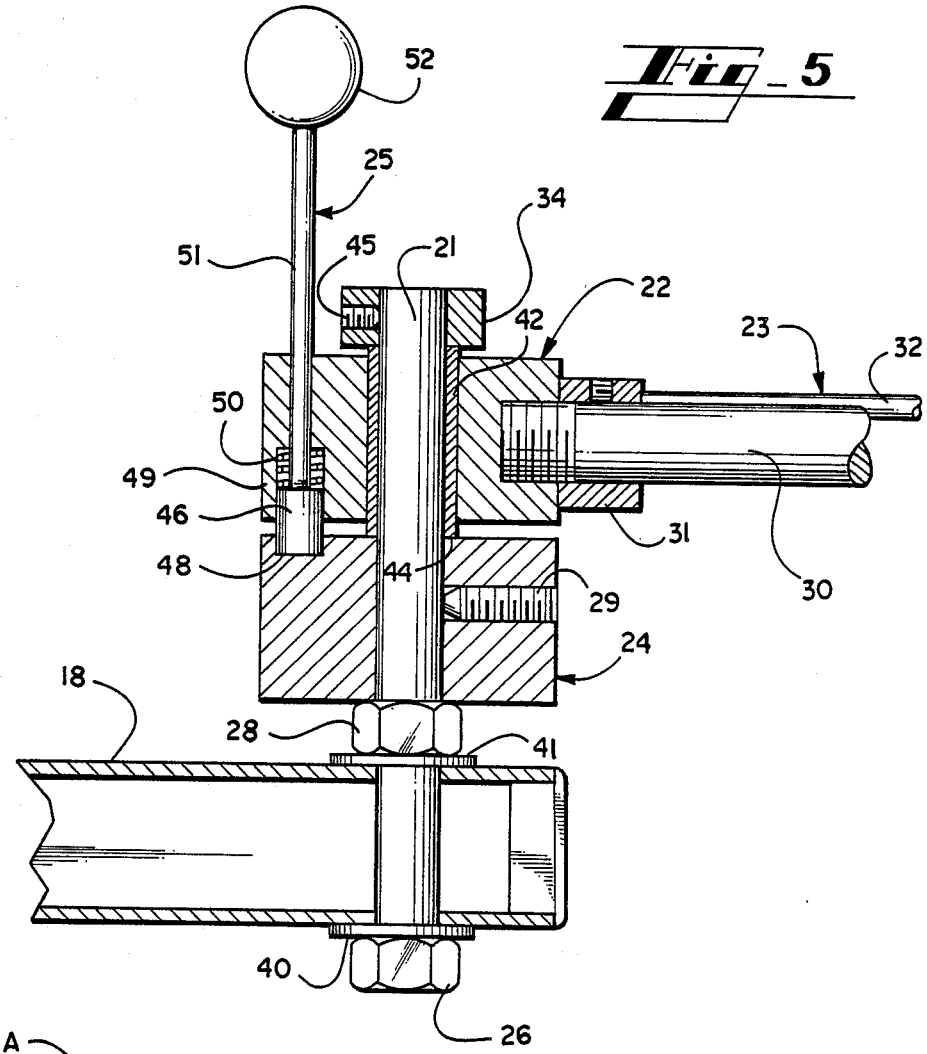
FIG. 5 is an enlarged, aligned, cross-sectional view through the support means shown in FIGS. 2 and 3.

For a detailed explanation of the construction of the pivotal support means 12, attention is directed to FIG. 5 of the drawings. In FIG. 5 it will be seen that the nuts 26 and 28 on each side of the arm 18 are provided with washers 40 and 41, the washers 40 and 41 preferably being lock washers. It will be understood that the pivotal support means 12 is subject to considerable jerks and vibration, and the lock washers 40 and 41 assist in keeping the post 21 substantially rigidly connected to the arm 18.

Above the nut 28, the latch block 24 rides on the nut 28. The latch block can be rotated about the centerline of the post 21 when the set screw 29 is loosened. Here again, it is important that the latch block 24 be firmly held in position except when it is being intentionally adjusted. It has been found that a knurled-point set screw performs admirably for this job, allowing adjustment as needed, but holding the intended adjustment when tightened.

The support block 22 is mounted on the post 21, the support block 22 including a bearing member 42. The bearing member 42 is here shown as a sleeve that extends somewhat above and below the support block 22. Since the support block 22 needs to be easily rotatable with respect to the post 21, the bearing 42 is important. The bearing 42 provides for easy rotation of the support block 22 about the post 21; also, it will be remembered that the support block 22 substantially rides on the latch block 24. Because the bearing 42 extends below the support block 22, it will be seen that the surface that rides against the latch block 24 is only the end 44 of the bearing 42. As a result, the frictional drag in the rotation of the support block 22 is quite low to provide great ease in operation.

The stop collar 34 at the upper end of the post 21 is held in place by a set screw 45.

Those skilled in the art will realize that a package of yarn will frequently weigh 10 to 15 pounds when full, and this weight must be considered in the mechanical construction of the pivotal support 12. While the support described thus far is easily formed of steel to have the necessary strength, it must also be realized that the latch has to withstand the forces generated by the great weight of a full package of yarn.

Looking then at the latch as illustrated in FIG. 5 of the drawings, it will be seen that the latch member 46 is preferably of a reasonably large diameter to be able to withstand the maximum shear forces between the support block 22 and the latch block 24. The latch member 46 is receivable into a notch 48 in the latch block 24, and is selectively reciprocable within an opening 49 in the support block 22. There is a spring 50 in the opening 49 above the latch member 46 to urge the latch member 46 normally downwardly to be received within the notch 48.

The latch operating handle 25 includes a stem 51 that is fixed to the latch member 46, perhaps by threads or the like, so the stem 51 can move the latch member 46 upwardly against the tension of the spring 50. For convenience in the operation of the latch, the latch handle 25 includes a reasonably large handle 52 which may be spherical or other easily grasped shape. It is also important to note that the handle 52 is sufficiently above the locking collar 34 that the mechanism will not interfere with the handle 52. The operator will therefore have no difficulty in grasping the handle 52 for quick and easy operation.

Those skilled in the art will realize that the cone holder 23 shown in FIG. 3 is known in the art. Also, it will be realized that, when a cone is placed on the cone holder, the wire 32 tends to sag somewhat, causing the package of yarn to point downward. Furthermore, as the yarn is removed from the cone the sagging becomes less and the package rises. These motions change the positioning of the yarn which creates misalignment of the yarn with the eyelet.

Figure 6:
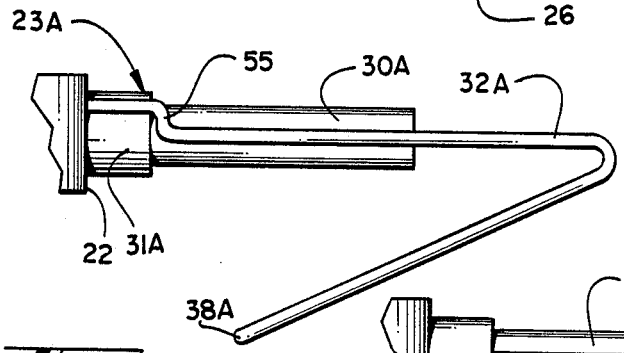
FIG. 6 is a side elevational view showing a modified form of cone holder for use with the present invention; and, FIG. 7 is a view similar to FIG. 6 but showing another modified form of cone holder.
Figure 7:
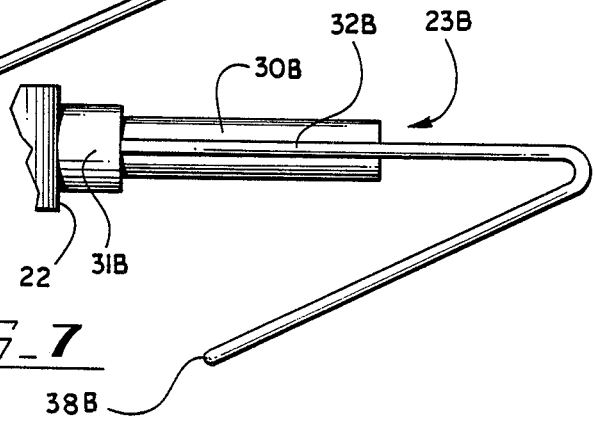

The cone holders shown in FIGS. 6 and 7 overcome the usual problems with cone holders by lowering the wires 32 sufficiently to allow the weight of the yarn package to be carried by the stud 30. The wire 32 provides the spring tension to hold the cone in place, while the stud carries the weight for better stability.

Looking first at FIG. 6, the wire 32A bends downwardly at 55 to place the length of the wires below the stud 30A. The bracket 31A can therefore be conventional, the wire 32A providing the difference in position.

Attention is next directed to FIG. 7. The cone holder 23B is the same as the cone holder 23A, except that the wire 32B is fixed to the bracket 31B at a lower point. Thus, the wire 32B is straight, but is below the stud 30B to allow the stud 30B to carry the weight of the yarn package.

The cone holders 23A and 23B are like the cone holder 23 except for the differences mentioned. Other parts carry the same reference numerals as the cone holder 23 with an A or B suffix, and no further description should be required.

With the above description in mind, operation of the apparatus should be readily understood. A plurality of the arms 18 will be fixed to the creel frame as desired for the number and general location of the yarn packages 11. Each arm 18 will have appropriate openings to receive the posts 21, the posts 21 being carefully locked in place by nuts and lock washers or the like. With the posts 21 in place, the latch block 24 can be received over the post 21 and the support block 22 is then received over the post 21, followed by the locking collar 24. With the support means 12 assembled, the latch member 46 can be engaged into the notch 48; then, with the set screw 29 loosened so the latchblock 24 is pivotal on the post 21, the support means can be rotated about the post 21 until the cone holding assembly 23 is pointed directly at the eyelet or other yarn guide means. At this point, the set screw 29 will be tightened to fix the latch block 24 in place.

Now, any time a yarn package 11 must be replaced, an operator can easily grasp the handle 52 and lift slightly to disengage the latch member 46 from the notch 48. As soon as the support block 22 has been rotated slightly with respect to the latch block 24, the handle 52 can be released and the latch member 46 will ride along the top surface of the latch block 24. The yarn package can be replaced, and the support block 22 rotated towards its original position. When the appropriate position is reached, the latch member 46 will be urged into the notch 48 by the spring 50, and the yarn holding means is again properly oriented for use of the new yarn package.

The cone holding assembly is simple, and easily replaced or modified as needed. Any of numerous conventional cone holding assemblies can be utilized in conjunction with the present invention, or one of the modified forms of cone holders can be used.

It will therefore be understood by those skilled in the art that the particular embodiment of the invention here presented is by way of illustration only, and is meant to be in no way restrictive; therefore, numerous changes and modifications may be made, and the full use of the equivalents resorted to, without departing from the spirit or scope of the invention as outlined in the appended claims.

I claim:

1. A yarn package support including a generally vertically extending post, a latch block received on said post and selectively fixed with respect to said post, a support block juxtaposed over said latch block and selectively pivotal about said post, said support block defining a central opening for receiving said post therein, and a bearing means within said opening in said support block for journaling said support block on said post, a cone holder carried by said support block and extending generally horizontally therefrom and pivotal therewith, and latch means carried by said support block for selectively latching said support block to said latch block for selectively preventing pivotal motion of said support block with respect to said latch block, said bearing means comprising a sleeve extending beyond said support block towards said latch block so that the weight of said support block is carried by said sleeve, a set screw threadedly engaged with said latch block and selectively engageable with said post, said latch means including a latch member slidably received in an opening in said support block, the lower end of said latch member being receivable within a notch in said latch block for positively latching said support block with respect to said latch block, and a handle for selectively releasing said latch means.

2. A yarn package support as claimed in claim 1, said latch means further including a spring within said opening in said support block for urging said latch member into said notch in said latch block.

3. A yarn package support as claimed in claim 2, and further including a latch stem fixed to said latch member and carrying said handle at the upper end thereof, said stem having sufficient length that said handle is above the upper end of said post.

4. A yarn package support as claimed in claim 1, said cone holder comprising a stud fixed to said support block, a bracket carried on said stud and a wire extending from said bracket, said wire extending generally parallel to said stud, and turning downwardly, said wire being so dimensioned as to engage a cone placed over said cone holder and frictionally hold the cone, said wire being below the upper surface of said stud so that said stud carries the weight of said cone.

5. A yarn package support as claimed in claim 4, said wire including bends at said bracket for placing said wire below said upper surface of said stud.

6. A yarn package support as claimed in claim 4, said wire being fixed to said bracket at such a location that said wire is below the upper surface of said stud.

7. A yarn package support in combination with a creel, said creel including vertical frame members for carrying said package support, and yarn guide means for receiving a strand of yarn from a yarn package, said yarn package support including an arm extending from one of said vertical frame members of said creel in a generally horizontal direction, said arm defining a hole in the extending and thereof, a post received in said hole, and extending vertically therefrom, means for fixing said post to said arm, a latch block carried on said post and means for selectively fixing said latch block to said post, a support block juxtaposed over said latch block and pivotal about said post, and latch means for selectively latching said support block with respect to said latch block, and a cone holder extending generally horizontally from said support block.

8. The combination as claimed in claim 7, said means for fixing said latch block to said post including a set screw threadedly engaged with said latch block and selectively engageable with said post.

9. The combination as claimed in claim 8, said latch means further including a latch member, said support block defining an opening therein for receiving said latch member, a spring within said opening in said support block for urging said latch member towards said latch block, said latch block defining a notch therein for receiving said latch member, the arrangement being such that, when said notch is aligned with said latch member, said spring will urge said latch member into said notch in said latch block.

10. The combination as claimed in claim 9, and further including a latch stem fixed to said latch member and, a handle at the upper Ⓡnd of said latch stem, said stem having sufficient length that said handle is beyond the end of said post.

11. The combination as claimed in claim 10, said support block defining a central opening for receiving said post wherein, and a sleeve bearing with said opening in said support block for journaling said support block on said post, said sleeve extending beyond said support block towards said latch block so that the weight of said support block is carried by said sleeve bearing.

* * * * *